US009822804B2

(12) United States Patent
Min

(10) Patent No.: US 9,822,804 B2
(45) Date of Patent: Nov. 21, 2017

(54) DOUBLE NOZZLE TYPE SMART POSITIONER

(71) Applicant: YOUNG TECH CO., LTD., Keonggi-Do (KR)

(72) Inventor: Du Gi Min, Incheon (KR)

(73) Assignee: Young Tech Co., LTD, Keonggi-do (KR)

( * ) Notice: Subject to any disclaimer, the term of this patent is extended or adjusted under 35 U.S.C. 154(b) by 0 days.

(21) Appl. No.: 14/994,340

(22) Filed: Jan. 13, 2016

(65) Prior Publication Data

US 2016/0208826 A1 Jul. 21, 2016

(30) Foreign Application Priority Data

Jan. 16, 2015 (KR) ..... 10-2015-0007986

(51) Int. Cl.
*F15B 5/00* (2006.01)
*F15B 13/16* (2006.01)

(52) U.S. Cl.
CPC ..... *F15B 13/16* (2013.01); *F15B 5/003* (2013.01); *F15B 2211/30575* (2013.01); *Y10T 137/2278* (2015.04); *Y10T 137/87209* (2015.04)

(58) Field of Classification Search
CPC ..... Y10T 137/2409; Y10T 137/2278; Y10T 137/7761; Y10T 137/86598; Y10T 137/87193; Y10T 137/87201; Y10T 137/87209; Y10T 137/87225; Y10T 137/87233; F15B 13/0438; F15B 13/07; F15B 13/08; F15B 5/003
USPC ..... 137/82, 85, 86, 596.14, 596.15, 596.16, 137/596.18, 625.6, 625.61, 625.62
See application file for complete search history.

(56) References Cited

U.S. PATENT DOCUMENTS

| | | | | |
|---|---|---|---|---|
| 2,709,421 A | | 5/1955 | Avery | |
| 2,841,168 A | | 7/1958 | Levetus et al. | |
| 3,426,258 A | | 2/1969 | Van Pelt | |
| 3,521,535 A | | 7/1970 | Oelrich | |
| 3,543,648 A | | 12/1970 | Stahle | |
| 4,152,971 A | * | 5/1979 | Leonard | F15B 9/08 137/625.6 |
| 5,027,858 A | * | 7/1991 | Gold | F15B 13/043 137/596.15 |

* cited by examiner

*Primary Examiner* — Matthew W Jellett
(74) *Attorney, Agent, or Firm* — Robert L. Stearns; Dickinson Wright, PLLC

(57) ABSTRACT

Provided is a double nozzle type positioner, which includes a flapper (1), a first nozzle (2) and a second nozzle (3) disposed at both sides based on the flapper (1), a first orifice (4) configured to maintain a constant pressure of the first nozzle (2), a second orifice (5) configured to maintain a constant pressure of the second nozzle (3), a first pilot valve (6) having an input portion connected to a feed pressure, a second pilot valve (7) having an input portion connected to an output portion of the first pilot valve (6), a discharge hole (8) connected to an output portion of the second pilot valve (7), and an actuator (9) connected to the output portion of the first pilot valve (6) and the input portion of the second pilot valve (7). If the first nozzle (2) is opened due to the movement of the flapper (1), the second nozzle (3) is closed, and if the first nozzle (2) is closed, the second nozzle (3) is opened.

3 Claims, 3 Drawing Sheets

[Fig. 1]
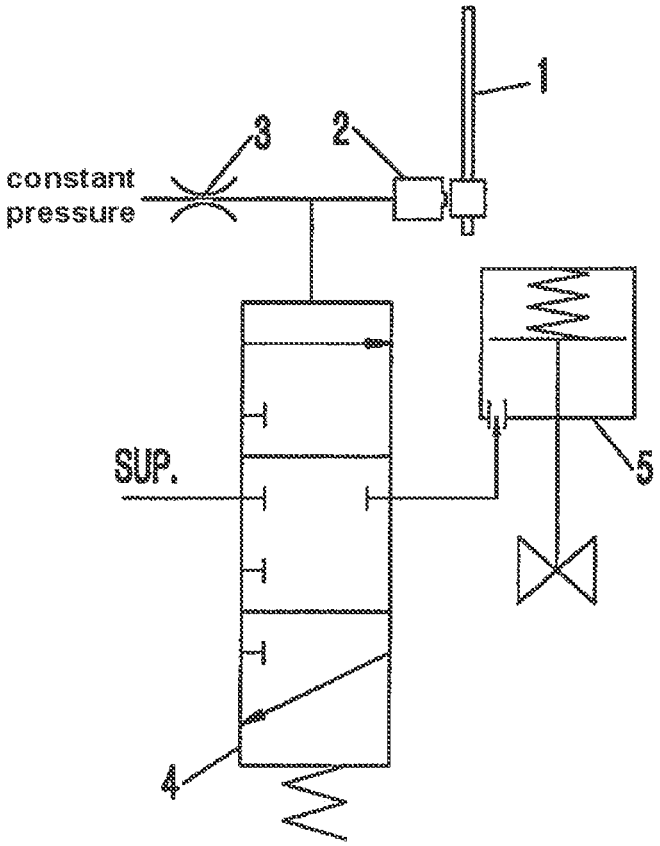

[Fig. 2]
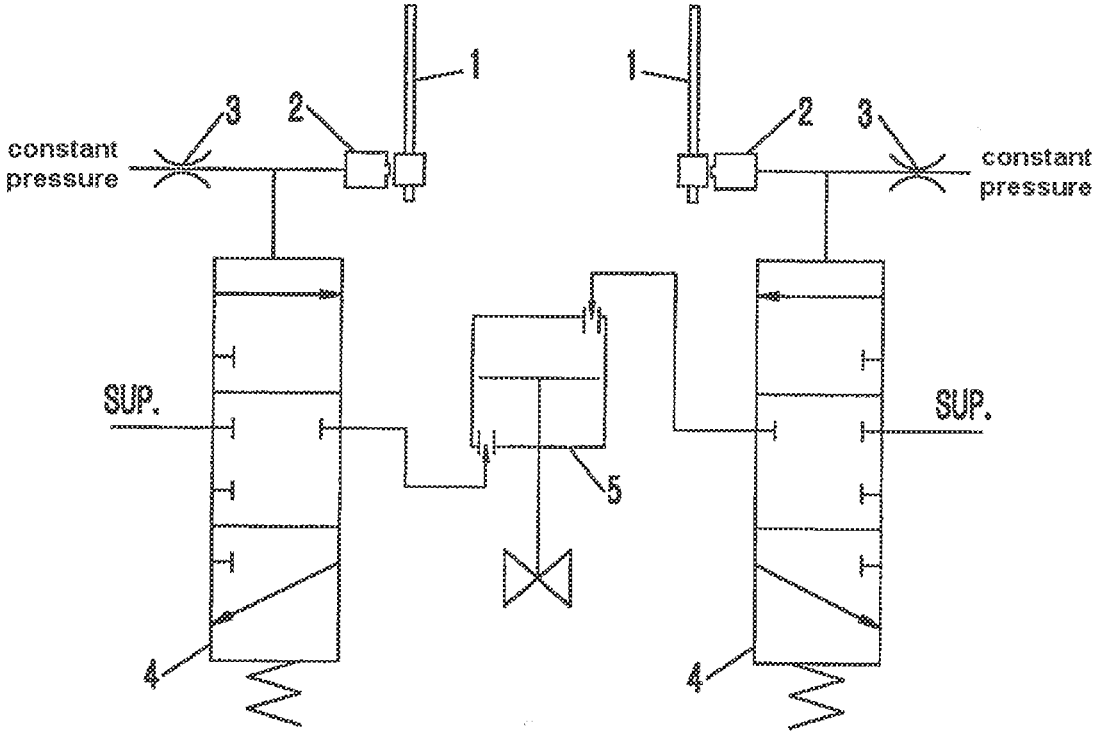

[Fig. 3]
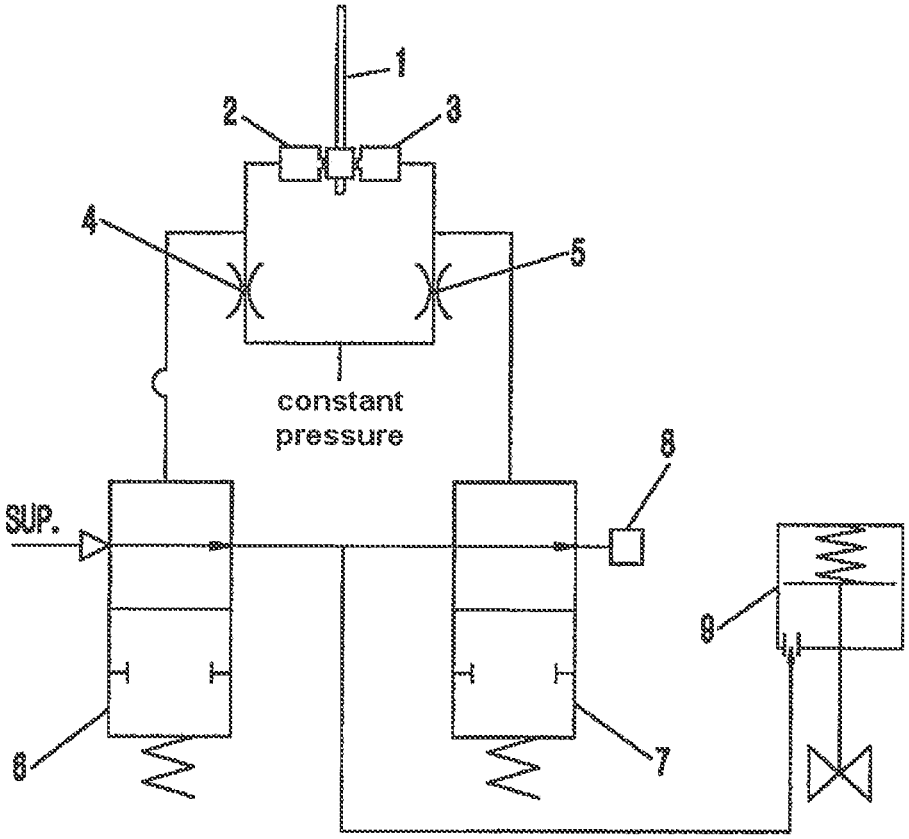

DOUBLE NOZZLE TYPE SMART POSITIONER

CROSS REFERENCE TO RELATED APPLICATION

This U.S. Utility application claims priority to Korean Patent Application No. 10-2015-0007986, filed Jan. 16, 2015, and is incorporated herein by reference.

BACKGROUND OF THE INVENTION

1. Technical Field

The present disclosure relates to a positioner for controlling an opening of a valve, and more particularly, to a double nozzle type positioner.

2. Related Art

A control valve represents a valve capable of adjusting an opening of a valve according to an external control signal and is an essential part giving a serious influence on efficiency and performance of various processing automations in power plants, water treatments, petrochemical industries or the like. In particular, the control valve is essential for controlling high-temperature and high-pressure fluid flowing in various tubes installed at a large plant such as a power plant, and the control valve not only controls a flow rate, pressure and flow direction of fluid but also performs main functions such as opening/closing of a channel, throttling, checking, overpressure protection or the like.

Generally, a control signal uses a current of 4 to 20 mA in order to prevent signal distortion against various kinds of noise generated at a site, and a pneumatic pressure is used as an auxiliary power source for operating a valve.

The control valve briefly includes a valve body, an actuator and a positioner, and is classified into a linear type valve and a rotary type valve depending on whether the valve is operated linearly or rotationally. The actuator plays a role of driving the valve by using a pneumatic pressure serving as an auxiliary power source to push a stem connected to the valve body or generate a rotation torque. Therefore, the specification of the actuator is determined according to power and moving distance (or, rotation angle) required for driving the valve body. The positioner is a control unit for measuring a plug opening by means of a sensor connected to the valve body (accurately, the stem), comparing the plug opening with a command signal (4 to 20 mA) input from the outside, and controlling a pneumatic pressure supplied to the actuator until the opening of the valve becomes identical to the command signal.

FIG. 1 shows an existing positioner including a single nozzle, a single flapper and a single pilot valve. The positioner includes a single flapper 1, a single nozzle 2 and a single pilot valve 4. In addition, the positioner further includes an orifice 3 for maintaining a constant pressure of the nozzle 2. An input portion of the pilot valve 4 is connected to the feed pressure, an output portion is connected to the actuator 5. At the output portion of the pilot valve 4, the actuator is operated according to a pneumatic pressure supplied to the actuator 5.

The positioner however has a drawback since the pneumatic pressure supplied to the output of the pilot valve 4, namely the actuator 5, is seriously influenced by external environments.

FIG. 2 shows an existing arrangement where two positioners are coupled to a single actuator in order to overcome the drawback of the positioner of FIG. 1. In this arrangement, two flappers 1, two nozzles 2, two orifices 3 and two pilot valves 4 are connected to a single actuator 5. For example, the output of one pilot valve 4 is connected to move the actuator 5 upwards, and the output of the other pilot valve 4 is connected to move the actuator 5 downwards. Each of these sets has the same configuration as the positioner of FIG. 1.

In this arrangement, the actuator 5 is operated due to a difference between the output of one pilot valve 4 and the output of the other pilot valve 4. In general, two pilot valves receive external influences similarly, and thus the external influences are offset at the difference in two outputs. As a result, this arrangement is not seriously influenced by external environments.

However, the assembling process for coupling positioners with an actuator becomes more cumbersome, and two positioners should be controlled at the same time. In other words, the actuator may malfunction due to timing between control signals for controlling two positioners and any error possibly existing at the outputs of the positioners.

SUMMARY OF THE INVENTION

The present disclosure is directed to providing a structure of a positioner, which may solve the above problems.

In one general aspect, the present disclosure provides a double nozzle type positioner, comprising: a flapper; a first nozzle and a second nozzle disposed at both sides of the flapper; wherein when the first nozzle is opened due to the movement of the flapper, the second nozzle is closed, and when the first nozzle is closed, the second nozzle is opened; a first pilot valve connected to the first nozzle; a second pilot valve connected to the second nozzle; a constant pressure source configured to constantly supply a pneumatic pressure to the first nozzle, the first pilot valve, the second nozzle and the second pilot valve; a first orifice configured to maintain the pneumatic pressure supplied from the constant pressure source to the first nozzle and the first pilot valve constantly; and a second orifice configured to maintain the pneumatic pressure supplied from the constant pressure source to the second nozzle and the second pilot valve constantly. An input portion of the first pilot valve is connected to a feed pressure, and the first pilot valve is configured to transfer the feed pressure supplied from the input portion of the first pilot valve to an output portion of the first pilot valve, according to the pneumatic pressure supplied from the constant pressure source to the first pilot valve, which is exclusively controlled by the opening and closing of the first nozzle. The output portion of the first pilot valve is connected to an input portion of the second pilot valve. The second pilot valve is configured to transfer the feed pressure supplied to the input portion of the second pilot valve to an output portion of the second pilot valve, according to the pneumatic pressure supplied from the constant pressure source to the second pilot valve, which is exclusively controlled by the opening and closing of the second nozzle, and the output portion of the second pilot valve is connected to a discharge hole. A fluid junction between the output portion of the first pilot valve and the input portion of the second pilot valve is connected to an actuator.

Here, the first nozzle and the second nozzle may be opened or closed by a single control current.

Here, the flapper may be configured to move in opposite directions according to polarities of the single control current.

If the double nozzle type positioner according to the present disclosure is used, two pilot valves may be proportionally controlled by using two nozzles, in addition, since both a positive current and a negative current are used, it is possible to control with a low current. Since two nozzles play a role of an auxiliary stopper, variations caused by external influences are small.

THE DRAWINGS

FIG. 1 is a diagram showing an existing positioner including a single nozzle, a single flapper and a single pilot valve.

FIG. 2 shows an existing arrangement where two positioners are coupled to a single actuator in order to overcome the drawback of the positioner of FIG. 1.

FIG. 3 is a diagram showing a double nozzle type positioner according to an embodiment of the present disclosure.

DETAILED DESCRIPTION

Hereinafter, a double nozzle type positioner according to an embodiment of the present disclosure will be described in detail with reference to FIG. 3.

FIG. 3 is a schematic diagram showing a double nozzle type positioner according to an embodiment of the present disclosure. The double nozzle type positioner includes a flapper 1, a first nozzle 2, a second nozzle 3, a first orifice 4, a second orifice 5, a first pilot valve 6, a second pilot valve 7 and a discharge hole 8. The first nozzle 2 and the second nozzle 3 are disposed at both sides of the flapper 1 based on the flapper 1. If the first nozzle 2 is closed due to the movement of the flapper 1, the second nozzle 3 is opened, and if the first nozzle 2 is opened, the second nozzle 3 is closed. If the flapper 1 is located at the center, both first and second nozzles 2, 3 are opened. The movement of the flapper 1 may be controlled by means of a control current provided to the flapper. For example, the flapper 1 may be configured to move in opposite directions according to polarities of a single control current.

The first nozzle 2 is connected to the first pilot valve 6. A constant pressure source for supplying a constant pressure to the first nozzle 2 and the first pilot valve 6 is connected between them. The second nozzle 3 is connected to the second pilot valve 7. A pressure source for supplying a constant pressure to the second nozzle 3 and the second pilot valve 7 is connected between them. These pressure sources may be a single pressure source. In order to constantly maintain the pressure supplied from the pressure source to the first nozzle 2 and the first pilot valve 6 and to the second nozzle 3 and the second pilot valve 7, the first orifice 4 and the second orifice 5 are respectively provided.

A separate feed pressure is connected to an input portion of the first pilot valve 6, and an output portion of the first pilot valve 6 is connected to an input portion of the second pilot valve 7. An output portion of the second pilot valve 7 is connected to the discharge hole 8. The output portion of the first pilot valve 6 and the input portion of the second pilot valve 7 are coupled and connected to an actuator 9 at a fluid junction.

Regarding the operations, if a positive control current is supplied to the flapper 1, the flapper 1 moves toward the first nozzle 2 to close the first nozzle 2, and the second nozzle 3 is opened. Since the first nozzle 2 is closed, the pressure supplied from the constant pressure source is entirely supplied to the first pilot valve 6. In addition, since the second nozzle 3 is opened, the pressure supplied to the constant pressure source is discharged through the second nozzle 3 and not supplied to the second pilot valve 7. Accordingly, the first pilot valve 6 discharges the input feed pressure through the output portion, and the input portion and the output portion of the second pilot valve 7 are closed. The pneumatic pressure output from the first pilot valve 6 is transferred to the actuator 9 to move the actuator 9, for example, upwards.

If a negative control current is supplied to the flapper 1, the flapper 1 moves toward the second nozzle 3 to close the second nozzle 3, and the first nozzle 2 is opened. As described above, the pressure supplied from the constant pressure source is provided to the second pilot valve 7 and is not provided to the first pilot valve 6. Therefore, the feed pressure input to the first pilot valve 6 is not output, and the input portion and the output portion of the second pilot valve 7 are opened. The pneumatic pressure existing at the actuator 9 is discharged through the second pilot valve 7 to the discharge hole 8, thereby moving the actuator 9, for example, downwards.

If a current is not supplied to the flapper 1, both nozzles are opened, the input portions and the output portions of both the first pilot valve 6 and the second pilot valve 7 are blocked, and the actuator 9 does not move.

The above description is just an example. For example, as an alternative, when a negative current is supplied to the flapper 1, the flapper 1 may move toward the first nozzle 2, and when a positive current is supplied to the flapper 1, the flapper 1 may move toward the second nozzle 3. In addition, the upward or downward movement of the actuator may be performed reversely or in different directions.

In the double nozzle type positioner according to the present disclosure, two positioners may be proportionally controlled by means of two nozzles. Since a polarity of a control current is used, it is possible to control with a low current. Also, since a single current is used, convenient installation and control is ensured. Since two nozzles play a role of a stopper, variations caused by external influences are small.

What is claimed is:

1. A double nozzle type positioner, comprising:

a flapper (1);

a first nozzle (2) and a second nozzle (3) disposed at both sides of the flapper (1);

wherein when the first nozzle (2) is opened due to the movement of the flapper (1), the second nozzle (3) is closed, and when the first nozzle (2) is closed, the second nozzle (3) is opened;

a first pilot valve (6) connected to the first nozzle (2);

a second pilot valve (7) connected to the second nozzle (3);

a constant pressure source configured to constantly supply a pneumatic pressure to the first nozzle (2), the first pilot valve (6), the second nozzle (3) and the second pilot valve (7);

a first orifice (4) configured to maintain the pneumatic pressure supplied from the constant pressure source to the first nozzle (2) and the first pilot valve (6) constantly; and a second orifice (5) configured to maintain the pneumatic pressure supplied from the constant pressure source to the second nozzle (3) and the second pilot valve (7) constantly, wherein an input portion of the first pilot valve (6) is connected to a feed pressure, and the first pilot valve (6) is configured to transfer the feed pressure supplied from the input portion of the first pilot valve (6) to an output portion of the first pilot valve (6), according to the pneumatic pressure supplied from the constant pressure source to the first pilot valve (6) which is exclusively controlled by the opening and closing of the first nozzle (2), wherein the output portion of the first pilot valve (6) is connected to an input portion of the second pilot valve (7), wherein the second pilot valve (7) is configured to transfer the feed pressure supplied to the input portion of the second pilot valve (7) to an output portion of the second pilot valve (7), according to the pneumatic pressure supplied from the constant pressure source to the second pilot valve (7) which is exclusively controlled by the opening and closing of the second nozzle (3), and the output portion of the second pilot valve (7) is connected to a discharge hole (8), wherein a fluid junction between the output portion of the first pilot valve (6) and the input portion of the second pilot valve (7) is connected to an actuator (9).

2. The double nozzle type positioner according to claim 1, wherein the movement of the flapper (1) is controlled by a single control current.

3. The double nozzle type positioner according to claim 2, wherein the flapper (1) is configured to move in opposite directions according to polarities of the single control current.

* * * * *